United States Patent [19]

Bowes, Jr.

[11] 4,320,925

[45] Mar. 23, 1982

[54] DREDGE CUTTERHEAD TOOTH

[75] Inventor: Stephen M. Bowes, Jr., Jacksonville, Fla.

[73] Assignee: Florida Machine & Foundry Co., Jacksonville, Fla.

[21] Appl. No.: 121,390

[22] Filed: Feb. 14, 1980

[51] Int. Cl.[3] ..... E21C 35/18; E02F 9/28

[52] U.S. Cl. ..... 299/90; 37/142 A; 175/383; 175/413; 175/421

[58] Field of Search ..... 299/88–90; 175/383, 413, 421; 37/142 R, 142 A, 67

[56] References Cited

U.S. PATENT DOCUMENTS

| | | | |
|---|---|---|---|
| 2,340,216 | 1/1944 | Gill | 37/67 |
| 2,702,698 | 2/1955 | Snyder et al. | 299/88 |
| 3,544,166 | 12/1970 | Proctor | 37/142 R X |
| 4,037,337 | 7/1977 | Hemphill | 37/142 R |

*Primary Examiner*—Ernest R. Purser
*Attorney, Agent, or Firm*—Arthur G. Yeager

[57] ABSTRACT

A rock cutting tooth assembly for a dredge cutterhead in which each tooth has a cutting edge formed by the intersection of a cutting face substantially lengthwise with the tooth and a flank substantially transverse to the tooth, the cutting face lying in a plane which intersects the axis of the base of the tooth at a location inwardly of said base, and said plane being angularly disposed with respect to a profile plane from the center of the cutterhead to the cutting edge. Preferably, there is disposed another such tooth with its cutting face oppositely facing the first tooth cutting face and the axis of the base of the tooth is angularly disposed with respect to the axis of the adapter landing.

58 Claims, 12 Drawing Figures

DREDGE CUTTERHEAD TOOTH

BACKGROUND OF THE INVENTION

1. FIELD OF THE INVENTION

This invention relates to rock cutting teeth and more particularly to the replaceable tooth and tooth assembly used on a dredging cutterhead.

2. DESCRIPTION OF THE PRIOR ART

Dredge cutterheads are generally conical with a multiplicity of hard rock cutting teeth projecting outwardly from helical support vanes or blades disposed about the conical surface of the cutterhead. The cutterhead normally has a hub which fits around a shaft that provides the torque for turning the cutterhead in its operation of dredging the bottom of waterways. Because the cutterhead encounters rock which must be removed, the teeth on the cutterhead are made of hard materials with high impact properties, but this is not sufficient to prevent wearing and breakage of the teeth. Accordingly, it is highly desirable to provide a tooth design that has improved life and wearing capabilities and ease of replacement.

The most common variety of replaceable tooth for a dredge cutterhead embodies a pyramidal shape which is attached by an adapter to the cutterhead blade in a manner such that the point of the pyramid is directed at the surface which is to be cut and the longitudinal axis of the tooth, generally passes through the centroid of the cutter blade section and is generally at an angle with respect to the profile plane of the cutterhead from the point of the pyramidal tooth so as to provide an efficient transmission of power to the tooth with a minimum of breaking force.

It has been determined in actual practice that most failures of dredge cutterhead teeth and the supporting adapters occur from the outside to the inside due to high shock loads from a combination of severe dredging conditions involving the excavation of rock. The forces which are involved are produced by abrupt encounters with boulders, high swing loads, and radial shock loads involving "ladder bounce" even when ladder weights in excess of 500 tons have been employed. An analysis of these factors has led to the design of an entirely new tooth which significantly reduces the possibility of breaking due to externally applied forces. The bending moments in the tooth in accord with one embodiment of the present invention are reduced almost fifty percent (50%) over the present pyramidal design. Furthermore, the present invention includes a bifurcated tooth, in which one cutting arm is operational while the other cutting arm is nonoperational, but when sufficient wear of the operational arm has been experienced, the tooth can be removed from the adapter and rotated 180° to bring the previously nonoperational cutting arm into the operational position while the arm with the worn cutting face or edge is placed in a nonoperational position. Thus, the tooth of the present invention has much longer useful life as compared to the prior art tooth. In accord with another embodiment of the present invention twice the wear life of the prior art tooth is obtained.

In accord with another embodiment of the invention the axis of the adapter and base of the tooth may be angled with respect to the axis of the adapter landing and the bifurcated teeth may be extended outwardly to the same radius of the normal single tooth cutting edge position, thus providing the approximate same length of tooth between the base and the cutting outer end portion as in the normal single tooth whereby approximately twice the life of the single point is achieved without increasing the torque requirements of the cutterhead, as would occur, if the bifurcated tooth were positioned on an adapter whose axis was aligned with its landing axis, with the axis of the base of the tooth also in alignment therewith.

A dredge cutterhead is shown by U.S. Pat. No. 3,808,716 and typical teeth for prior art dredge cutterheads are shown by U.S. Pat. No. 3,708,895 and by U.S. Pat. Nos. Des. 244,683 and 244,597. Other known U.S. Pat. Nos. are 640,622; 993,474; 3,544,166; and 4,098,013. Also there exist two Holland Patent Application Nos. 7808654 and 7808655, published on Mar. 8, 1979. Edge cutters for bucket excavators are also known with bifurcated teeth as shown in the November 1978 issue of "World Dredging and Marine Construction", page 30.

It is an object of this invention to provide a novel tooth for a dredging cutterhead. It is another object of this invention to provide a novel rock cutting tooth assembly for use in a dredging cutterhead. It is still another object of this invention to provide a novel bifurcated tooth for use in rock cutting operations in which only one tooth is operational unless rotated 180°. A specific object is the provision of an extended wear life dredge cutter tooth. A particularly object is to provide a dredge cutter tooth which is more resistant to breakage from "ladder bounce" and other shock loads. Still other objects will appear from the more detailed description of this invention which follows.

SUMMARY OF THE INVENTION

This invention includes a rock cutting tooth assembly for a generally conical dredge cutterhead having a plurality of teeth, each with a female recess in the rearward end of the base of the tooth which interfits with a forward male end of an adapter affixed to the adapter landing of the cutterhead with releaseable means for locking the tooth into the adapter and with antirotation means engaging the tooth with the adapter to prevent relative rotation about an axis therebetween. The present invention embodies a tooth having a cutting edge formed by the intersection of a cutting face substantially lengthwise with the tooth and a flank generally transverse to the tooth, such cutting face being angularly divergent from the axis of the adapter and the tooth and lying in a plane which intersects such axis inwardly of the base of the tooth, such axis passing approximately through the centroid of the supporting cutter blade, such plane being preferably exclusive of the profile plane that passes through from the center of the cutterhead to the cutting edge. In specific embodiments of this invention the tooth is bifurcated with two arms symmetrically positioned about the axis of the base of the tooth. In other embodiments of this invention the flank of the tooth is a rectangle or a trapezoid. In still another embodiment of this invention the two arms of the bifurcated tooth are joined with a chisel-edge web for reinforcement. An improved longer tooth is also provided in accord with another embodiment by angularly disposing the adapter toward the cutter with respect to the axis of the adapter landing. This longer tooth can also be used with the aligned axes of the adapter and adapter landing, even though a decreased torque will be achieved, but which embodies reduced breaking moments in excess of twenty five percent (25%) as compared to the standard single point tooth.

BRIEF DESCRIPTION OF THE DRAWINGS

The novel features believed to be characteristic of this invention are set forth with particularly in the appended claims. The invention itself, however, both as to its organization and method of operation, together with further objects and advantages thereof, may best be understood by reference to the following description taken in connection with the accompanying drawings in which:

DESCRIPTION OF THE PREFERRED EMBODIMENTS

Figure 1:
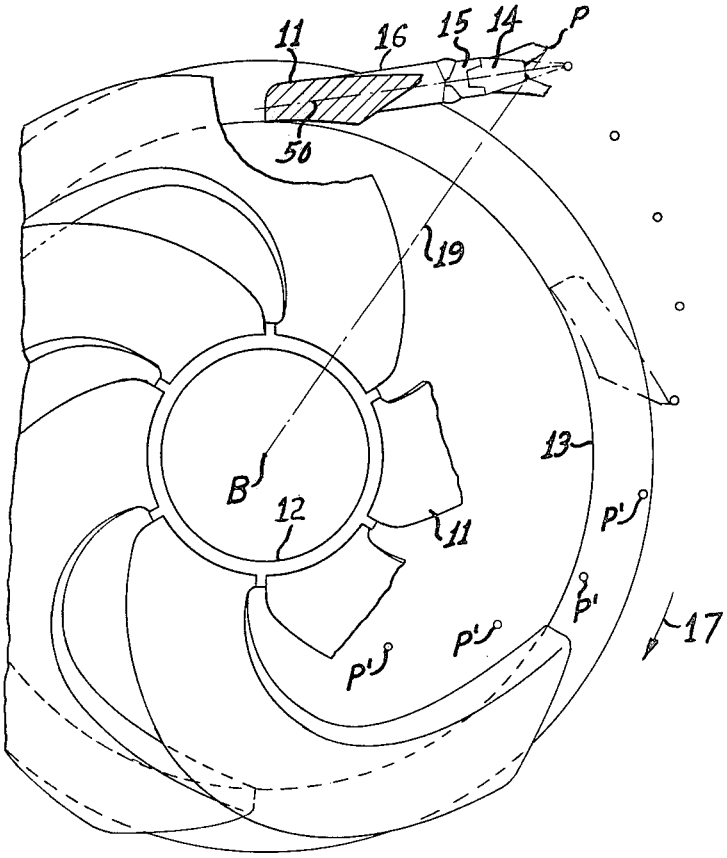
FIG. 1 is a top plan view of a portion of a dredge cutterhead fitted with a rock cutting tooth assembly in accord with this invention the cutterhead being partially broken away and only a single tooth assembly being shown for clarity of illustration.
Figure 2:
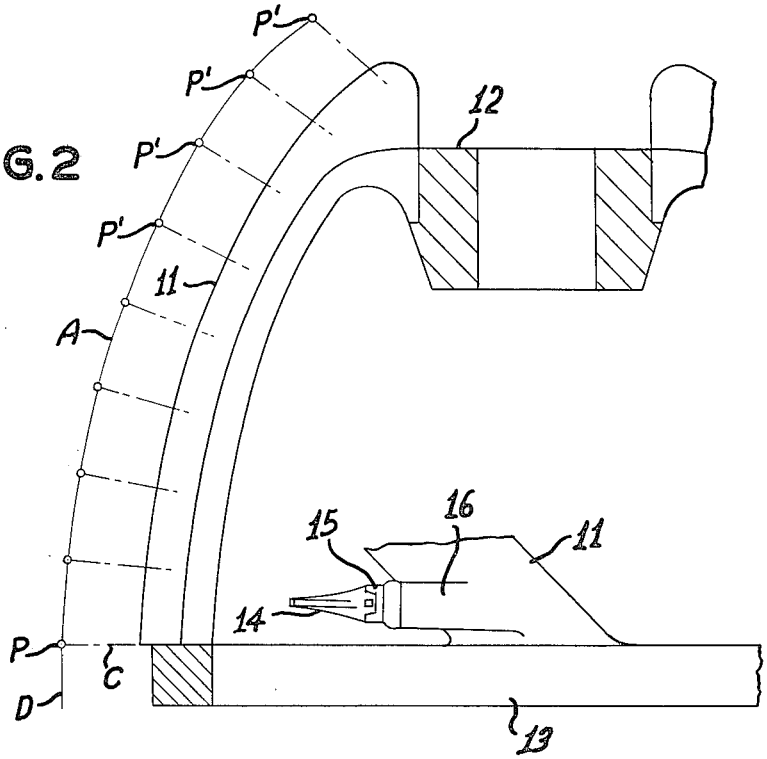
FIG. 2 is a side elevational view, partially in section, of a portion of the dredge cutterhead shown in FIG. 1.

With reference to FIGS. 1 and 2, the teeth on a dredge cutterhead are generally equally spaced along the cutter profile A and are pitched with respect to a profile plane 19. The profile plane 19 is an imaginary plane that passes through and includes the cutter centerline or axis of rotation B. The teeth are generally arranged so that a plane formed by the tooth centerline 50 and the profile plane 19 to which it is pitched is usually perpendicular as at C to a tangent line D to the cutter profile A at the tooth point position P.

It is to be understood that tooth point position P in FIGS. 1 and 2 is not a true tooth point position, since it lies in the plane of the ring 13. However, for the purpose of illustration and description, bifurcated tooth 14 is shown in the imaginary point position P rather than an up position from the ring 13, for example, at appropriate other points P'.

The upper teeth positions along, for example, the first three rows, may be individually positioned and not governed by the general description set forth above. This upper row positioning of the teeth is important in order to minimize excessive torsional loads to the upper teeth, specifically when the single off-set tooth of FIG. 7 or the bifurcated tooth in accord with this invention is employed on the cutterhead.

With respect to FIGS. 1 and 2 the general arrangement of a dredge cutterhead can best be understood. The outer contour of the cutterhead is generally conical in shape made up of a series of vanes or blades 11 helically disposed from a central hub 12 to an outer supporting ring 13. Blades 11 serve as the support for a series of adapter landings 16 projecting outwardly from blades 11 and positioned specifically relative to a profile plane, for example, like profile plane 19. The direction of rotation of the cutterhead is shown by arrow 17 and adapter landings 16 generally project outwardly from blade 11, pointed in the direction of rotation, the centerline axis 50 of landing 16 being coincident to that of the blade section and passing approximately through the blade centroid. To the end of each landing 16 is welded an adapter 15 having a male end to receive a complemental female recess in tooth 14.

Figure 3:
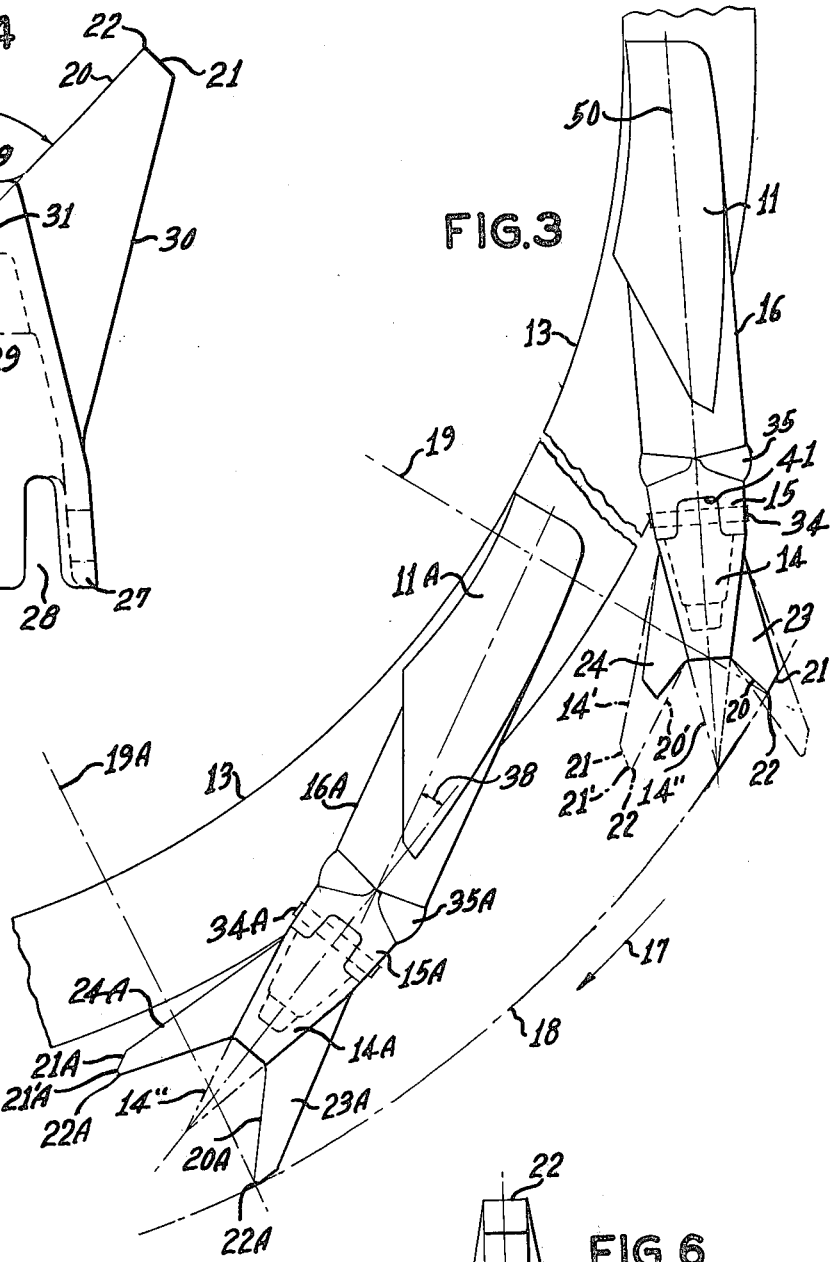
FIG. 3 is a schematic illustration of two teeth each of which is oriented differently with respect to the cutterhead.

With respect to FIG. 3, the precise positioning of teeth 14 and 14A as alternative positions can best be understood. Landings 16 and 16A are either welded onto blade 11 of the cutterhead or made as integral parts of the cutterhead when originally manufactured, projecting outwardly and at an angle with ring 13, the centerline 50 of which normally is coincident with the blade centerline which in turn usually passes approximately through the blade centroid, but can be located at an angle with respect thereto, and the landings 16 and 16A generally point in the direction of travel of the cutterhead, as shown by arrow 17. Adapters 15 and 15A are welded, as at 35 and 35A to the end of landings 16 and 16A and can be positioned with any angular disposition desired with respect to the axes of landings 16 and 16A. In the right hand tooth arrangement the axis of adapter 15 is positioned in alignment with landing axis 50, while in the left hand arrangement adapter 15A is turned at an angle 38, for example 10°–45°, in the direction toward the cutter. The determination of whether to make adapters 15 or 15A coaxial with, or angularly disposed to, landings 16 or 16A depends on several factors. Since in both cases the cutting edge 22 or 22A travels along the circumference 18 at the same radial distance from the central axis B of the cutterhead, the torsional moment and the torque are the same in each case. The forces which tend to produce breakage or shear off tooth arm 23 or 23A are greater with respect to 23A than with respect to 23. However, by positioning adapter 15A at an angle with the axis of landing 16A, tooth arm 23A can be made longer than is the case with the coaxial arrangement of landing 16 and adapter 15. This provides a longer life for the tooth because there is more tooth to be worn away before reaching a final critical worn stage at which point the tooth may be repositioned or replaced, as the case may be. Generally it is preferred that angle 38 be between 10° and 45° so as to gain the most in life of the tooth without sacrificing too much in the risk of fracture. If the tooth 14A were mounted on the adapter 15, as illustrated by broken lines 14' in the right hand tooth arrangement, the radius of the cutter would increase with resultant decreased cutting forces with the same torque being applied to the cutter and the likelihood of breakage would increase over tooth 14, but would still result in less breaking moment on the order of twenty-five percent (25%) from externally applied loads than a standard single point tooth 14''.

Tooth 14 has a cavity at the base of the tooth which interfits with a corresponding male projection on adapter 15 in such a fashion that there is substantially no relative rotation about the common axis of adapter 15 and tooth 14 with respect to these two components.

Normally this is accomplished by having spaced flanges 27 mate with sockets 41 and the tooth 14 is locked into place with adapter 15 in any suitable manner, as by a pin 34 driven through the flanges 27 and adapter 15, as more clearly illustrated in U.S. Pat. No. 3,708,895.

Figure 4:
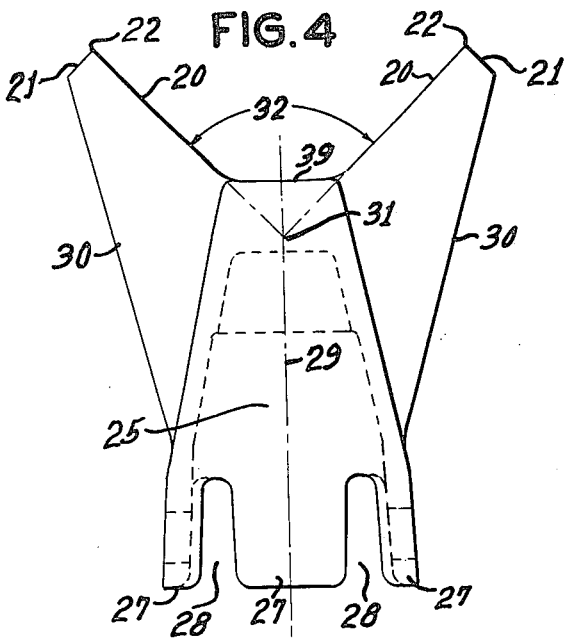
FIG. 4 is a front elevation view of a bifurcated tooth of this invention.

Tooth 14 is shown in FIGS. 3 and 4 as a bifurcated tooth having an operating tooth portion of cutting arm 23 and nonoperating tooth portion cutting arm 24. When operating cutting arm 23 has become sufficiently worn to be replaced, pin 34 is removed, tooth 14 is rotated 180°, and pin 34 is replaced. This would move arm 23 to the nonoperating position and place arm 24 in the operating position for continued dredging operations. Each of the two arms 23 and 24 has a cutting edge 22 formed by the intersection of cutting face 20 and flank 21, as shown most clearly in FIG. 4.

The tooth 14 as compared to the prior art single tooth illustrated by broken lines 14'', has several advantages, namely, that the control or development point is the same and the torsional load of and on the cutter will be the same, that the bending or adapter breaking loads at the weld area 35 will be reduced by about fifty percent (50%) , and the tooth life may be slightly increased. Since there is less metal in the short tooth 14 as compared to the single tooth 14'', one of the teeth of 14 will wear sooner than 14'' but the two teeth or arms of 14 will provide some longer total tooth life for 14 than 14''. Also, there is presented some roughness of operation of the cutter when the tooth arm wears down toward the base 25 which fits onto the adapter requiring tooth rotation sooner than complete weardown of the arm.

As the cutterhead moves in the direction of arrow 17 cutting edge 22 moves in a circumferential path 18. The plane of cutting face 20 is usually not in a position whereby it includes profile plane 19. Although the angle between profile plane 19 and cutting face 20 can be on either side of profile plane 19, it is preferred that it be in the direction shown in this drawing wherein cutting edge 22 is the leading edge of the tooth and is the first porton of arm 23 which touches anything along path 18 as the tooth moves in the direction of arrow 17. Preferably this angle is about 2°-40°. The foregoing description also applies to tooth 14A and its respective parts. With respect to the angle between profile plane 19 or 19A and cutting face 20 or 20A the angle will be smaller between 19 and 20 (e.g. 2°-20°) than between 19A and 20° (e.g. 15°-40°).

Figure 5:
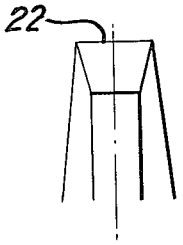
FIG. 5 is a partial view showing a trapezoidal configuration of the blank of the tooth of FIG. 4.
Figure 6:
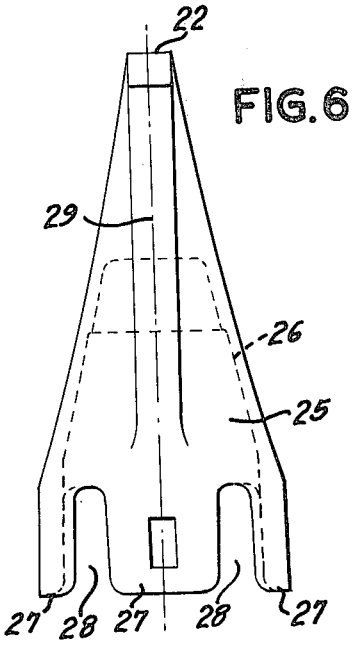
FIG. 6 is a side elevation view of the tooth of FIG. 4.
Figure 9:
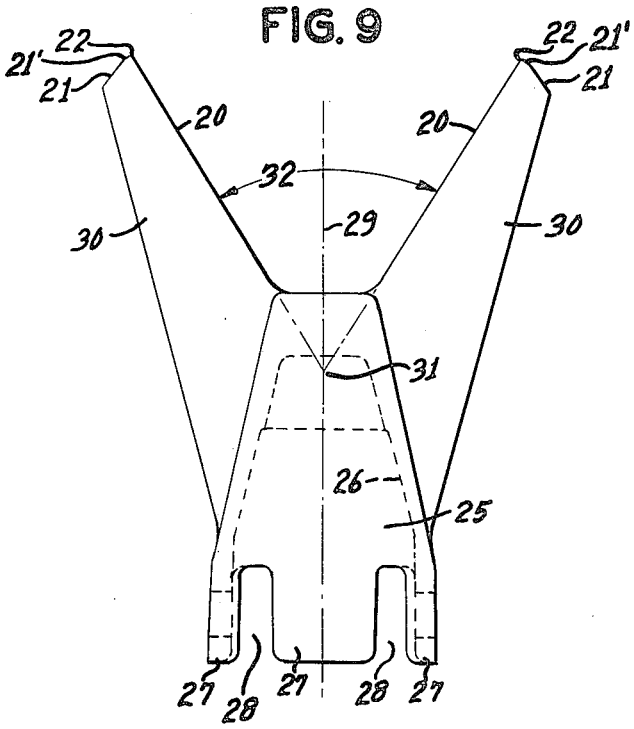
FIG. 9 is a front elevation view of another embodiment of the bifurcated tooth of this invention.

In FIGS. 4-6 there may be seen the details of a bifurcated tooth of this invention. In general the tooth is comprised of a base 25 and two cutting arms 30 with base 25 having an internal female cavity of a shape and size to correspond with the male projection of an adapter. Base 25 is normally made with a multiplicity of flanges or fingers 27 and slots or sockets 28 to interfit with corresponding slots or sockets and flanges or fingers on the adapter to which the tooth will be joined. Each arm 30 is generally pyramidal in shape and terminates in a cutting edge 22 formed by the intersection of the plane of cutting face 20 and the plane of flank 21. It is to be understood that flank 21 of the tooth of FIG. 4 may initially be formed to have a generally perpendicular portion 21', as shown in FIGS. 3 and 9 with respect to the plane of the face 20', but upon a small amount of wear the plane of the flank 21' will intersect the plane of face 20' as will be understood in the art. In other words, in casting practice, sharp edges or corners between the planes of flank 21 and face 20 would be eliminated. In use and practice, the intersection between the flank 21 and face 20 is a function of the pitch of the tooth relative to the plane of rotation and in general a sharp edge will result soon after use is begun regardless of the intersection initially formed on the tooth. The entire tooth is symmetrical about central axis 29. The planes of cutting face 20 intersect axis 29 at 31 inwardly of the base of the tooth, which extends from fingers 27 to shoulder 39. The included angle 32 between cutting faces 20 should be not less than about 40° and not more than about 120°, preferably about 50°-110°, the lower end of this range being generally suited for the arrangement wherein tooth 14A is angularly disposed to adapter 15A as in the left hand portion of FIG. 3 or a long tooth like 14' is used as in the right hand portion of FIG. 3, while the upper end of this range is generally suited for the arrangement wherein the short tooth 14 and adapter 15 are aligned as in the right hand portion of FIG. 3. Flank 21 may take any of several shapes although quadrilateral shapes are preferred with rectangular and trapezoidal being the most desirable. In FIG. 5 flank 21 is shown to be trapezoidal oriented such that the longer of the two parallel sides of the trapezoid is cutting edge 22. FIG. 6 illustrates the design wherein flank 21 is rectangular.

Figure 7:
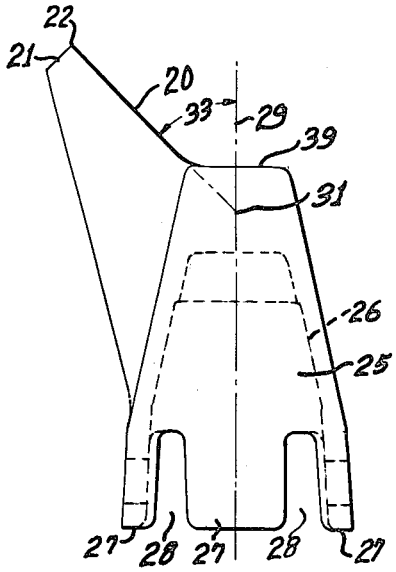
FIG. 7 is a front elevation view of a tooth of this invention having a single cutting arm.
Figure 8:
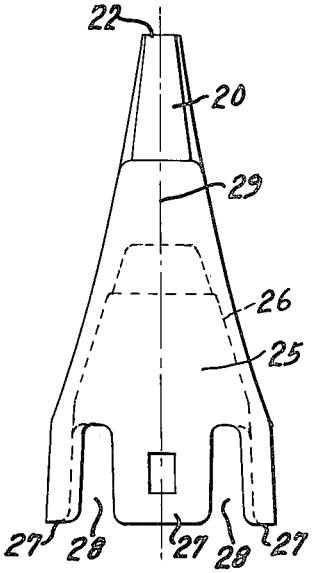
FIG. 8 is a right side elevation view of the tooth of FIG. 7.

In FIGS. 7 and 8 there may be seen a tooth which has only a single cutting arm and is not, therefore, bifurcated. This tooth is otherwise identical to the design of the tooth in FIGS. 4-16. The plane of cutting face 20 intersects axis 29 at point 31 which is inward of the base of the tooth. Angle 33 is determined to be between 20°-60°, preferably 45°, for the tooth if positioned in accord with the right hand arrangement in FIG. 3.

Figure 10:
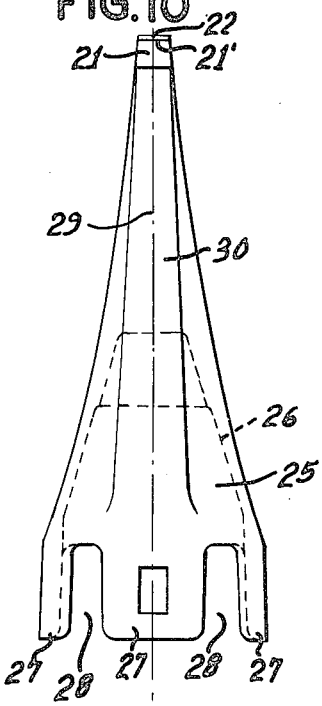
FIG. 10 is a side elevation view of the tooth of FIG. 9.

In FIGS. 9 and 10 there is shown another embodiment of a bifurcated tooth in which cutting arms 30 are somewhat longer than that shown in the tooth of FIGS. 4-6. Nevertheless the basic features of the two types of teeth remain within the required ranges. Angle 32 may be appropriately selected from about 55°-75°. The planes of cutting faces 20 both intersect axis 29 at point 31 which is rearwardly within the base 25 of the tooth. Flank 21 is shown to be rectangular although it is to be understood that it can be any other quadrilateral shape, including trapezoidal. An advantage of such longer arms 30 is that the life of the tooth is extended because there is more metal in arm 30 to wear away during usage thereof, and reduces the adverse influence caused by the base of the tooth and the other tooth face forming a yoke in which the flow of the material being cut may be inhibited.

Figure 11:
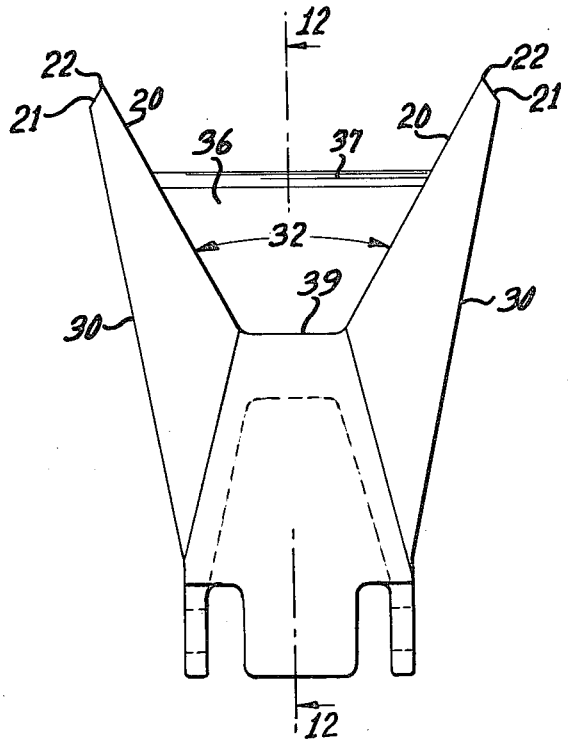
FIG. 11 is a front elevation view of a bifurcated tooth wherein the two cutting arms are joined by a reinforcing web in accord with this invention.
Figure 12:
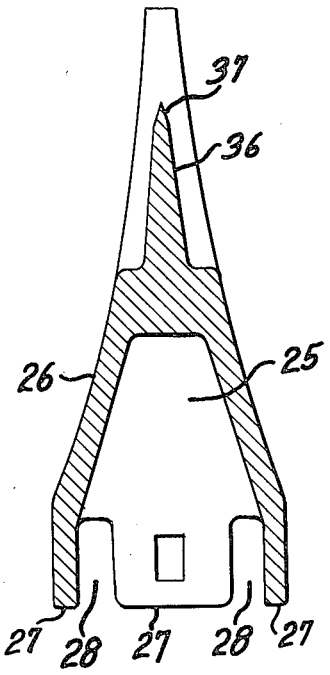
FIG. 12 is a cross-sectional view taken along line 12—12 of FIG. 11.

In FIGS. 11 and 12 there is shown a bifurcated tooth similar to those depicted in FIGS. 4 and 9 except that reinforcing web 36 joins arms 30 each other. This web 36 serves the purpose of strengthening arms 30 against fracture and minimizing the yoke effect described above. It is desirable but not necessary that the edge of web 36 be sharpened to a chisel edge in order to facilitate cutting through whatever the cutterhead encounters. The chisel edge 37 shown herein has two faces tapering to a center edge, but it is to be understood that a single taper to an edge on either side of web 36 may also be employed. Edge 37 may join arms 30 at any location between cutting edge 22 and shoulder 39.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a rock cutting tooth assemby for a generally conical dredge cutterhead or the like including a female recess in the rearward end of a base of a tooth having a longitudinal axis and adapted to interfit with a forward male end of an adapter affixed to the cutterhead, and releasable means for locking said tooth onto the adapter, the improvement comprising an elongated tooth having a cutting face extending substantially lengthwise of said tooth and a flank extending substantially transverse to said face, the intersection of said cutting face and said flank forming the cutting edge of said tooth, said cutting face being angularly divergent outwardly from said longitudinal axis, said cutting face lying in a plane which intersects said longitudinal axis at a location inwardly of the base of the tooth, said cutting edge being substantially perpendicular to said longitudinal axis when projected in the same plane.

2. In the assembly as defined in claim 1 in which the plane of said cutting face is exclusive of a profile plane which includes the axis of rotation of said cutterhead and said cutting edge.

3. In the assembly as defined in claim 1 in which said flank is a substantially rectangular planar surface.

4. In the assembly as defined in claim 1 in which said flank is a substantially trapezoidal planar surface with the wider of the two parallel sides of the trapezoid being said cutting edge.

5. In the assembly as defined in claim 1 in which said plane of said cutting face is inclined at an angle of 20°–60° with respect to said longitudinal axis.

6. In the assembly as defined in claim 1 wherein said tooth has two substantially identical cutting edges, cutting faces, and flanks arranged symmetrically about said longitudinal axis.

7. In the assembly of claim 6 wherein the planes including each of said cutting faces intersect at an included angle of 40°–120°.

8. In the assembly as defined in claim 6 further comprising an elongated reinforcing web connecting said cutting faces to each other.

9. In the assembly as defined in claim 8 wherein said web includes an outer chisel edge disposed generally midway of the length of said faces.

10. In the assembly as defined in claim 8 wherein said web includes an outer chisel edge connecting the two cutting edges.

11. In the assembly as defined in claim 6 in which the angle between said cutting faces is about 50°–100°.

12. In the assembly as defined in claim 6 in which the length of said tooth extends substantially the same length as a single point tooth in which the longitudinal axes of said adapter and its adapter landing which affixes said adapter to said cutterhead are substantially aligned.

13. In the assembly as defined in claim 6 in which the longitudinal axis of said adapter is angularly disposed toward the center said cutterhead with respect to the longitudinal axis of the adapter landing which affixes said adapter to said cutterhead, the length of said tooth extending substantially to the same radius of said cutterhead as a single point tooth in which said longitudinal axes of said adapter and adapter landing are substantially coincident.

14. In the assembly as defined in claim 2 wherein the angle between said cutting face plane and said profile plane is about 2°–40°.

15. In the assembly as defined in claim 1 comprising another tooth affixed to said tooth base and located in a position to be inoperable on the cutterhead and movable into operable position by movement of said tooth into an inoperable position.

16. In the assembly as defined in claim 1 in which said longitudinal axis of said adapter is angularly disposed toward the center of said cutterhead with respect to the longitudinal axis of the adapter landing which affixes said adapter to said cutterhead.

17. In the assembly as defined in claim 16 in which the length of said tooth extends substantially to the same radius of said cutterhead as a single point tooth in which said longitudinal axes of said adapter and adapter landing are substantially coincident.

18. In the assembly as defined in claim 17 wherein said tooth is bifurcated into two teeth with one tooth being angularly disposed with respect to the other and only one tooth is operable at any time during rotation of the cutterhead.

19. In the assembly as defined in claim 16 wherein said tooth is bifurcated into two teeth with one tooth being angularly disposed with respect to the other and only one tooth is operable at any time during rotation of the cutterhead.

20. In a rock cutting tooth assembly for a generally conical cutterhead including a plurality of adapters each having respective longitudinal axes angularly projecting from said cutterhead, each capped with a tooth by the engagement of a male end on said adapter with a female recess in the base of said tooth, the improvement comprising a plurality of bifurcated teeth each tooth of which includes a base and two divergent forwardly directed arms disposed symmetrically about respective said axes, each of said arms having an inner face and a transverse flank which intersect in a cutting edge, said inner face lying in a plane which intersects respective said axes at a point inwardly of said tooth base.

21. In the assembly as defined in claim 20 in which said plane is angularly disposed with respect to the profile plane of said cutterhead which includes said cutting edge.

22. In the assembly as defined in claim 21 in which the longitudinal axis of each said adapter is angularly disposed toward the center said cutterhead with respect to the longitudinal axis of the adapter landing which affixes said adapter to said cutterhead, the length of each arm of said tooth extending substantially to the same radius of said cutterhead as a single point tooth in which said longitudinal axes of said adapter and adapter landing are substantially coincident.

23. In the assembly as defined in claim 20 in which said flank is a substantially quadrangular planar surface.

24. In the assembly as defined in claim 23 in which said flank is a substantially rectangular planar surface.

25. In the assembly as defined in claim 23 in which said flank is a substantially trapezoidal planar surface with the wider side of the two parallel sides of the trapezoid being said cutting edge.

26. In the assembly as defined in claim 20 in which said plane of said inner face is inclined at an angle of 20°–60° with respect to said axis.

27. In the assembly as defined in claim 20 further comprising an elongated reinforcing web connecting said inner faces to each other.

28. In the assembly as defined in claim 27 wherein said web includes an outer chisel edge disposed generally midway of the length of said faces.

29. In the assembly as defined in claim 27 wherein said web includes an outer chisel edge connecting the two cutting edges.

30. In the assembly as defined in claim 20 in which the longitudinal axis of each said adapter is angularly disposed toward the center said cutterhead with respect to the longitudinal axis of the adapter landing which affixes said adapter to said cutterhead.

31. In the assembly as defined in claim 30 in which the length of each arm of said tooth extends substantially to the same radius of said cutterhead as a single point tooth in which said longitudinal axes of said adapter and adapter landing are substantially coincident.

32. In the assembly as defined in claim 31 wherein only one of said arms of said tooth is operable at any time during rotation of the cutterhead.

33. In the assembly as defined in claim 30 wherein only one of said arms of said tooth is operable at any time during rotation of the cutterhead.

34. In the assembly as defined in claim 20 in which the length of each arm of said tooth extends substantially the same length as a single point tooth in which the longitudinal axes of said adapter and its adapter landing which affixes said adapter to said cutterhead are substantially aligned.

35. In the assembly as defined in claim 20 in which the longitudinal axis of each said adapter is substantially coincident with the longitudinal axis of its respective adapter landing which affixes said adapter to said cutterhead.

36. In the assembly as defined in claim 35 in which said tooth in operable cutting position extends substantially to the same radius as a single point tooth mountable on said adapter.

37. In the assembly as defined in claim 20 in which the longitudinal axis of each said adapter is substantially aligned with the longitudinal axis of the adapter landing which affixes said adapter to said cutterhead, the length of each arm of said tooth extending substantially the same length as a single point tooth in which said longitudinal axes of said adapter and adapter landing are substantially coincident whereby the radius of said cutterhead is lengthened.

38. In the assembly as defined in claim 20 in which one of said tooh arms of each said tooth is operable and the other of said arms is operable upon movement of said tooth 180° with respect to said axis of its said adapter after removal therefrom and reattachment thereof, the longitudinal axis of each said adapter is angularly disposed toward said cutterhead with respect to the longidudinal axis of the adapter landing which affixes said adapter to said cutterhead, said tooth operable arm extending substantially to the same radius as a single port tooth mountable on said adapter.

39. In the assembly as defined in claim 20 in which the longitudinal axis of each said adapter is substantially coincident with the longitudinal axis of its respective adapter landing which affixes said adapter to said cutterhead, said tooth in operable cutting position extending substantially the same length as a single point tooth mountable on said adapter whereby the radius of said cutterhead is lengthened.

40. In the assembly as defined in claim 20 in which one of said tooth arms is operable and the other of said arms is operable upon movement of said tooth 180° with respect to said axis of its said adapter after removal therefrom and reattachment thereof.

41. In the assembly as defined in claim 40 in which the axis of each said adapter is angularly disposed toward said cutterhead with respect to the longitudinal axis of the adapter landing which affixes said adapter to said cutterhead.

42. In the assembly as defined in claim 40 in which the longitudinal axis of each said adapter is substantially coincident with the longitudinal axis of its respective adapter landing which affixes said adapter to said cutterhead.

43. A reversible rock cutting tooth having a rearward end containing a base portion and a forward end containing two divergent arms projecting forwardly and outwardly from said base portion, said tooth being in symmetrical arrangement about the longitudinal axis of said base portion, said base portion containing a rearwardly opening interior cavity, each of said arms having a substantially planar inner face and a substantially a planar flank intersecting at the forward end of said inner face in a cutting edge, the rearward ends of said inner faces joined together to produce the forward end of said base portion, said inner face lying in a plane that intersects said axis at a point inwardly of said base portion.

44. The tooth of claim 43 wherein said flank is a quadrangle.

45. The tooth of claim 44 in which said quardrangle is a rectangle.

46. The tooth of claim 44 in which said quadrangle is a trapezoid oriented with the wider of its two parallel sides being said cutting edge.

47. The tooth of claim 43 wherein each of said inner faces is inclined with respect to said axis in the amount of 40°-60°.

48. The tooth of claim 47 in which the angle of inclination is 25°-50°.

49. The tooth of claim 43 which further comprises a reinforcing web joining said two inner faces and extending from said base portion to a forward chisel edge.

50. The tooth of claim 49 wherein said chisel edge is approximately midway between said cutting edge and said base portion.

51. The tooth of claim 49 wherein said chisel edge joins said cutting edges.

52. The tooth of claim 45 wherein said plane intersects said axis at a point between said cavity and the forwardmost extent of said base portion.

53. The tooth of claim 43 in which each arm of said tooth is substantially equal to a single point tooth.

54. The tooth of claim 43 in which each arm of said tooth has a length substantially equal to a single point tooth.

55. The tooth of claim 43 further comprising a reinforcing web joining said inner faces and spaced from the forward end thereof toward said base thereof.

56. The tooth of claim 55 wherein said web includes a forward edge portion sharpened into a chisel edge.

57. The tooth of claim 43 in which said tooth is mountable on an adapter having a coincident axis with respect to the axis of the adapter landing or on an adapter having an axis disposed angularly toward said cutterhead with respect to the axis of the adapter landing.

58. The tooth of claim 57 in which each arm has a length substantially equal to a single point tooth mountable on the adapter.

* * * * *